US006273845B1

(12) United States Patent
Liou

(10) Patent No.: US 6,273,845 B1
(45) Date of Patent: Aug. 14, 2001

(54) LOAD APPLYING DEVICE FOR EXERCISERS

(76) Inventor: Jiann Bang Liou, No. 12, Avenue 37, Lane 122, Der Long Road, Taipeig City, Taichung (TW), 411

( * ) Notice: Subject to any disclaimer, the term of this patent is extended or adjusted under 35 U.S.C. 154(b) by 0 days.

(21) Appl. No.: 09/541,008

(22) Filed: Mar. 31, 2000

(51) Int. Cl.[7] ..... A63B 22/06; B60L 7/00
(52) U.S. Cl. ..... 482/63; 188/164
(58) Field of Search ..... 482/51, 57.65, 482/1–10; 188/164, 161, 163

(56) References Cited

U.S. PATENT DOCUMENTS 4,775,145 10/1988 Tsuyama ..... 272/73
5,711,404 * 1/1998 Lee ..... 188/164
5,848,953 * 12/1998 Wei et al. ..... 482/63
5,851,165 * 12/1998 Wei et al. ..... 482/63

* cited by examiner

*Primary Examiner*—Stephen R. Crow
(74) *Attorney, Agent, or Firm*—Charles E. Baxley, Esq

(57) ABSTRACT

A magnetic load applying device includes a plate secured on a spindle, and a rotating disc rotatably secured on the spindle and having a peripheral fence engaged on the plate. One or more arms each supports one or more magnets and each has one end rotatably secured to the plate for moving the magnets toward and away from the peripheral fence of the rotating disc and for adjusting the brake torque of the magnets applied onto the rotating disc. One or more springs may bias the arms and the magnets toward the peripheral fence of the rotating disc.

5 Claims, 7 Drawing Sheets

LOAD APPLYING DEVICE FOR EXERCISERS

BACKGROUND OF THE INVENTION

1. Field of the Invention

The present invention relates to a load applying device, and more particularly to a load applying device for exercisers.

2. Description of the Prior Art

U.S. Pat. No. 4,775,145 to Tsuyama discloses a typical load applying device for exercisers and comprises an electromagnetic mechanism for applying the brake torque to the rotating disc. The electromagnetic mechanism applies the brake torque to only a small peripheral portion of the rotating disc and thus may not uniformly apply the brake torque to the rotating disc.

The present invention has arisen to mitigate and/or obviate the afore-described disadvantages of the conventional exerciser load applying devices.

SUMMARY OF THE INVENTION

The primary objective of the present invention is to provide a magnetic load applying device for adjusting the brake torque of the magnets applied to the rotating disc of the exercisers.

In accordance with one aspect of the invention, there is provided a magnetic load applying device comprising a spindle, a plate secured on the spindle, a rotating disc rotatably secured on the spindle and including a peripheral portion, at least one arm including a first end rotatably secured to the plate at a pivot pin, and including a second end, at least one magnet secured on the arm, and means for rotating the arm about the pivot pin to move and to adjust the magnet relative to the peripheral portion of the rotating disc and to adjust a brake torque applied onto the rotating disc.

The rotating means includes means for biasing the arm and the magnet toward the peripheral portion of the rotating disc; and includes a follower rotatably secured onto the spindle and coupled to the second end of the arm for rotating the arm about the pivot pin when the follower is rotated about the spindle; and includes at least one cable coupled between the follower and the second end of the arm for rotating the arm about the pivot pin.

The follower includes at least one extension extended radially outward therefrom and coupled to the second end of the arm for rotating the arm about the pivot pin. The plate includes at least one stud extended therefrom, the extension includes a groove formed therein for receiving the stud and for limiting a relative rotational movement between the follower and the plate.

The rotating means includes a block slidably received in the plate, a first cable coupled between the block and the follower, and a second cable coupled to the block for moving the block relative to the plate to rotate the follower about the spindle. A cover is further secured to the plate for retaining the arm and the other elements between the plate and the cover.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
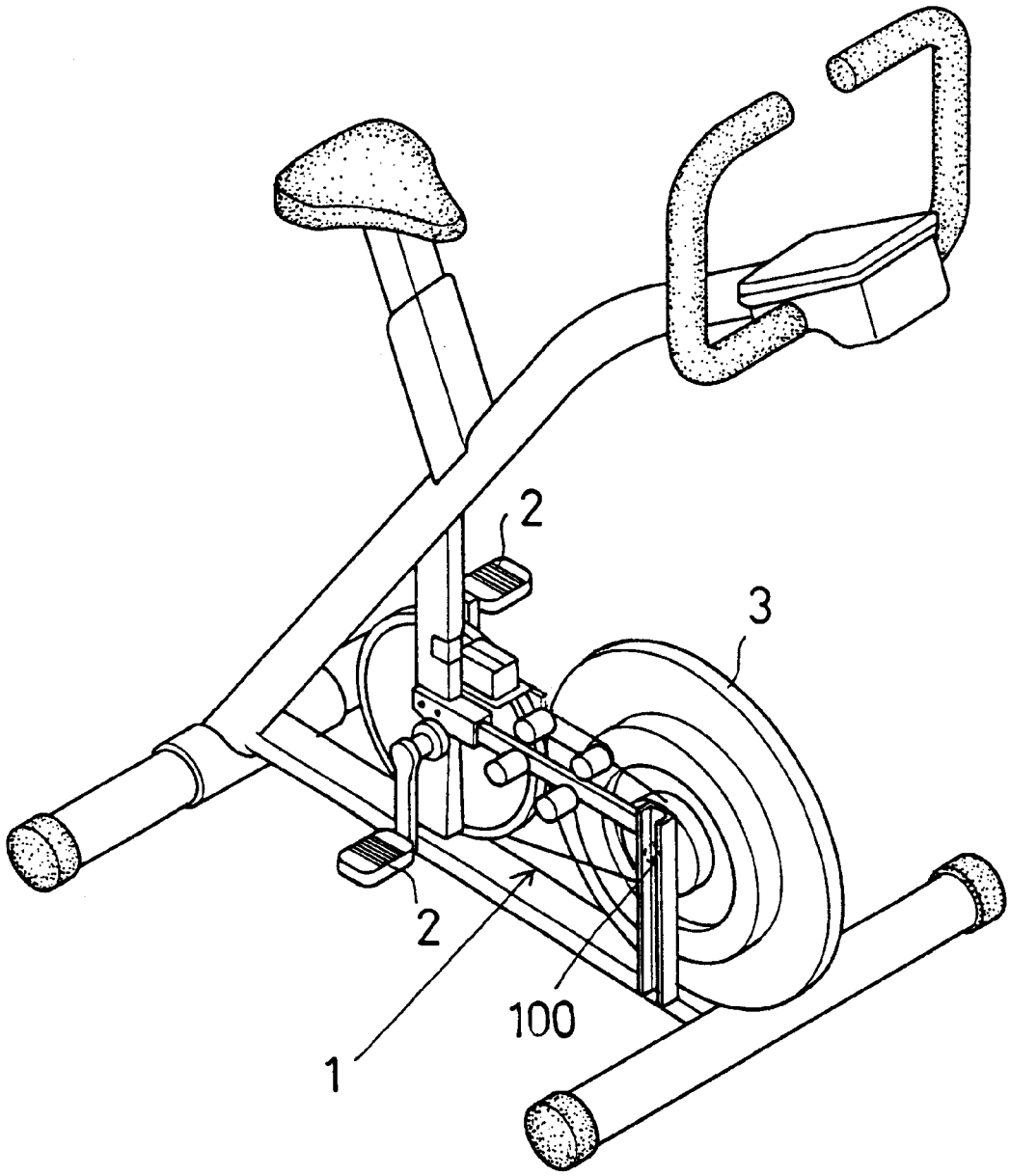
FIG. 1 is a perspective view of an exerciser having a magnetic load applying device in accordance with the present invention.
Figure 5:
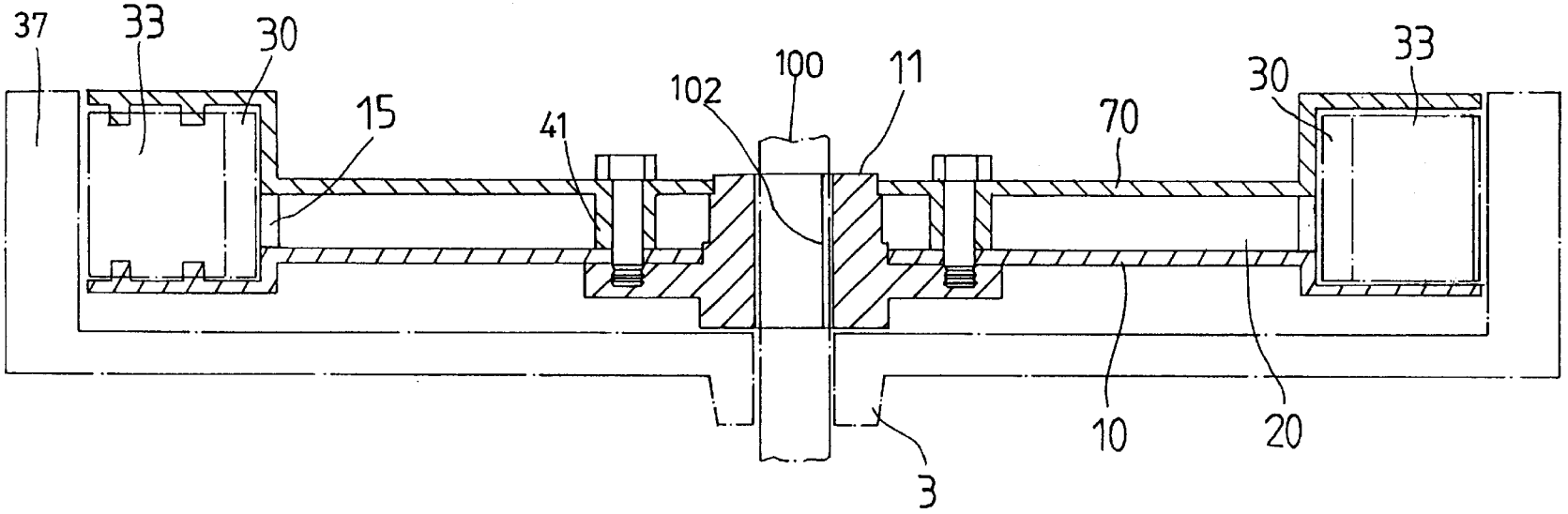
FIG. 5 is a cross sectional view taken along lines 5—5 of FIG. 4.

Referring to the drawings, and initially to FIG. 1, a magnetic load applying device in accordance with the present invention is provided for attaching onto an exerciser having a pair of foot pedals 2 coupled to a rotating disc 3 via a sprocket-and-chain coupling mechanism or a pulley-and-belt coupling mechanism 1 or the like for driving the rotating disc 3 and for conducting the cycling exercises. The rotating disc 3 is rotatably coupled to the support of the exerciser at a spindle 100 (FIGS. 1, 5), and includes a peripheral fence 37 extended laterally from the outer peripheral portion thereof (FIG. 5).

Referring next to FIGS. 2–5, the magnetic load applying device comprises a plate 10 and a cover 70 secured together with fasteners or the like, and received in the peripheral fence 37 of the rotating disc 3. A hub 11 is secured to the center of the plate 10 anchor the cover 70 with fasteners and is secured onto the spindle 100 with such as a key 102 (FIG. 5), such that the plate 10 and the cover 70 may be secured to the spindle 100 and may not rotate relative to the spindle 100. The plate 10 includes a circular bulge or base 13 formed in the middle portion thereof and includes a number of studs 41 extended from the peripheral portion thereof and/or extended from the base 13 and extended toward and engaged with the cover 70 for forming a space between the plate 10 and the cover 70 (FIG. 5) and for receiving the magnets therein. The base 13 includes one or more peripheral recesses 14 formed in the peripheral portion thereof and includes one or more walls 15 extended toward the cover 70 from the peripheral portion thereof. The walls 15 each includes a cavity 17 formed therein for receiving a spring 40. The base 13 or the plate 10 includes a slot 16 formed therein for slidably receiving a block 80.

Figure 2:
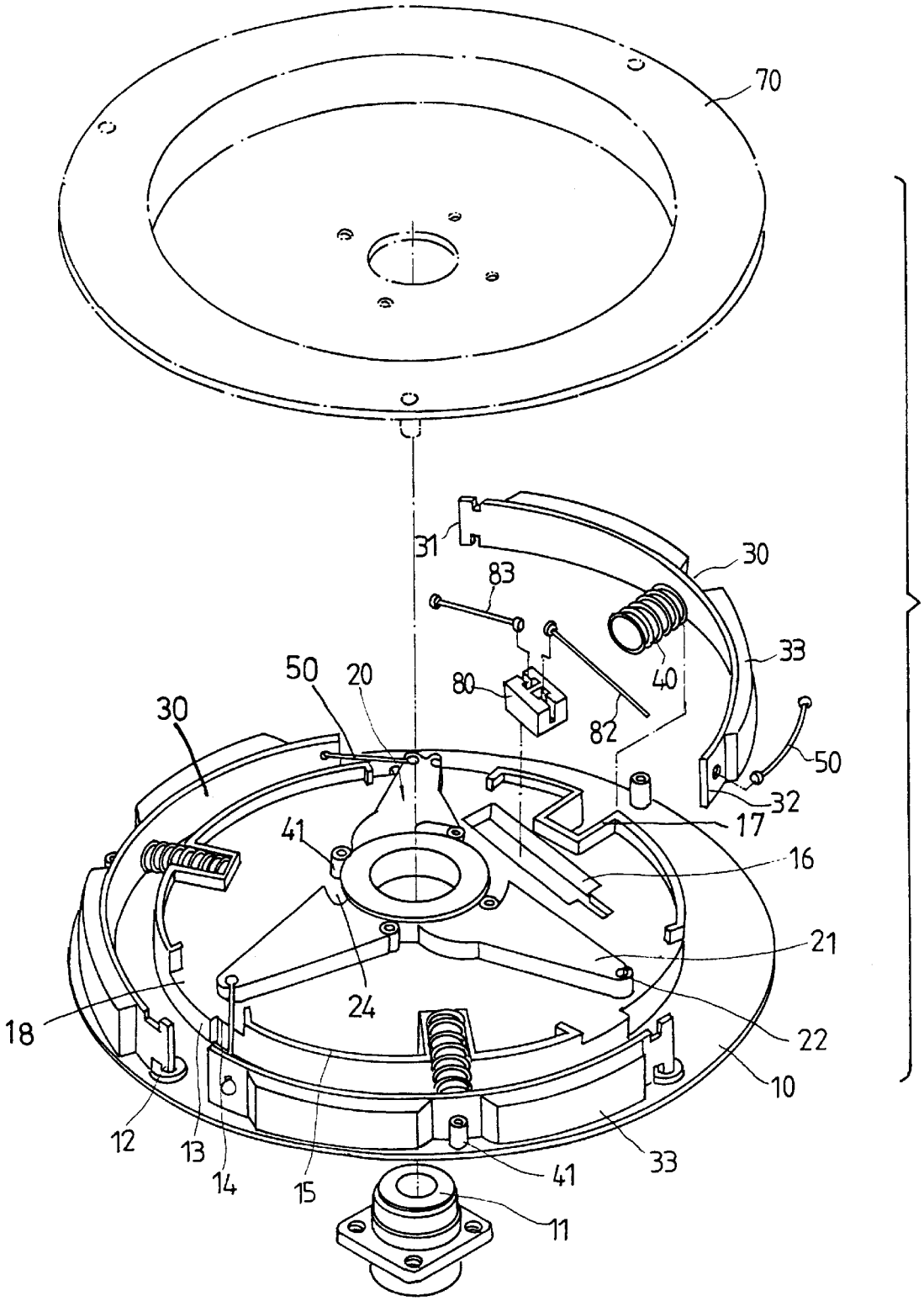
FIG. 2 is a partial exploded view of the magnetic load applying device.
Figure 3:
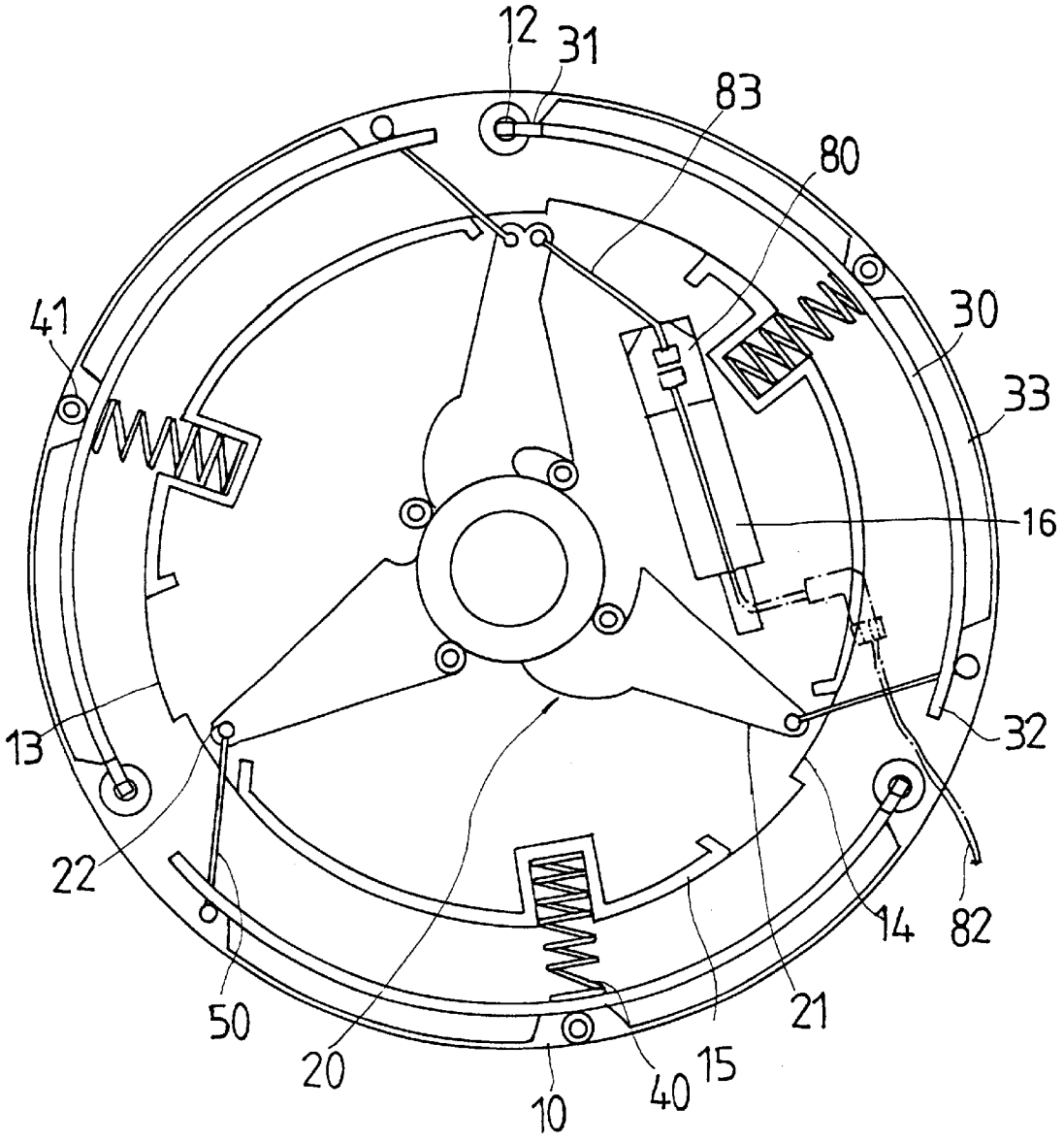
FIG. 3 is a plane view of the magnetic load applying device, in which a cover is removed for showing the inner structure of the magnetic load applying device.
Figure 4:
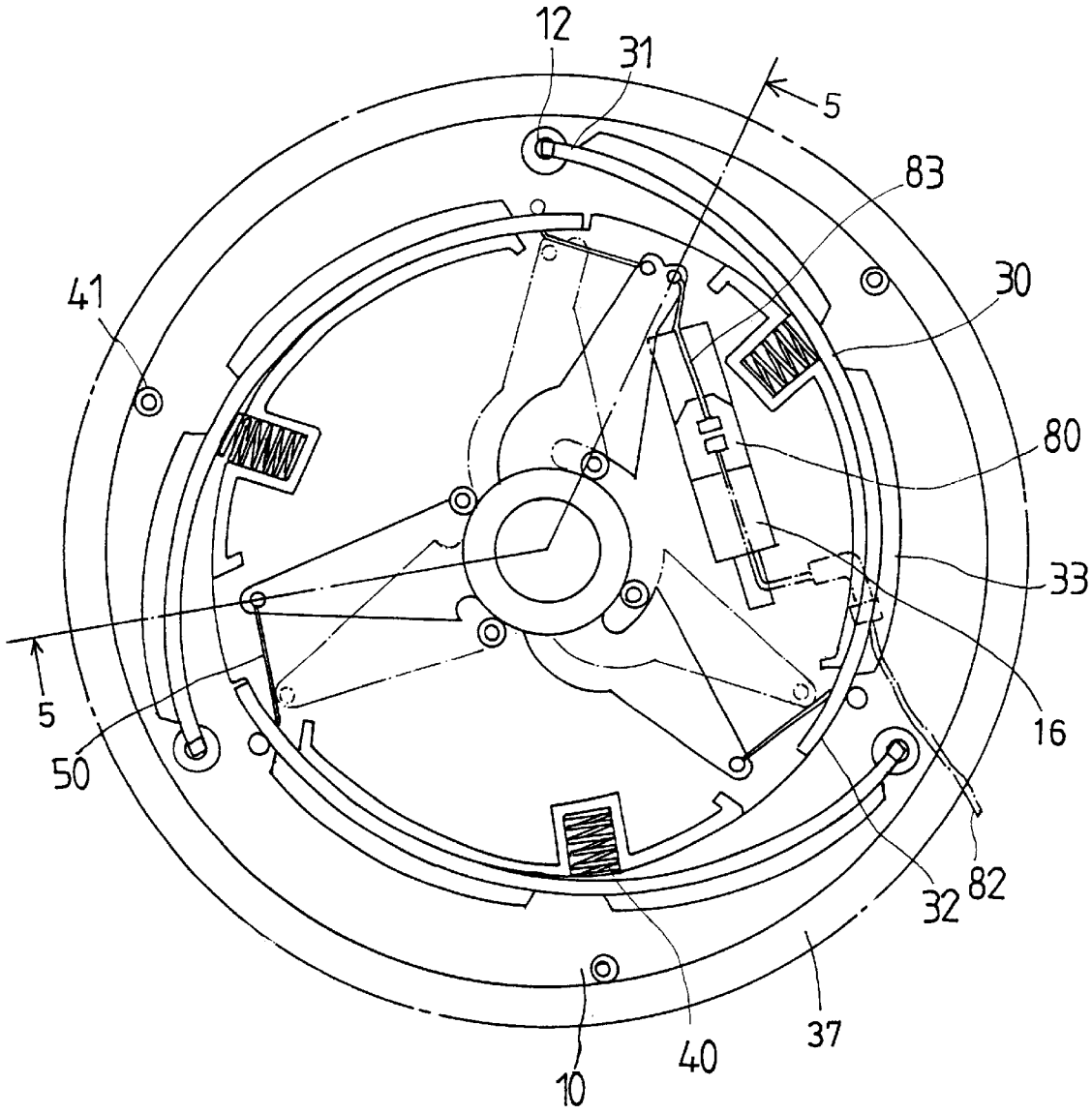
FIG. 4 is a plane view of the magnetic load applying device, similar to FIG. 3, illustrating the other application of the magnetic load applying device, in which the cover is also removed for showing the inner structure of the magnetic load applying device.

A follower 20 is rotatably engaged on the hub 11 or directly and rotatably engaged on the spindle 100 and includes one or more extensions 21 extended radially outward therefrom. The extensions 21 each includes a root portion having one or more grooves 24 (FIG. 2) formed therein for receiving the studs 41 which may limit the rotational movement of the follower 20 relative to the plate 10 and the cover 70. One or more arms 30 each includes a curved structure and each includes one end rotatably secured to the plate 10 at a pivot pin 31 or the like and each includes the other end 32 coupled to the respective free ends 22 of the extensions 21 of the follower 20 by a coupling member, such as a cable 50 such that the arms 30 may be rotated about the respective pivot pins 31 by the follower 20 when the follower 20 is rotated about the spindle 100 (FIGS. 3, 4). The cables 50 may be extended through the notches 18 (FIG. 2) of the wall 15. The arms 30 each includes an outer peripheral portion having one or more magnets 33 secured thereon. As shown in FIGS. 2–4, three arms 30 are secured onto the plate 10 and are arranged around the base 13 of the plate 10 in a circular shape.

As best shown in FIGS. 2–4, the free end 22 of one of the extensions 21 of the follower 20 is coupled to the block 80 with a cable 83. Another cable 82 has one end secured to the block 80 and has the other end coupled to a typical brake handle that may be attached to the handle of the exerciser, such that the block 80 may be moved along the channel 16 of the plate 10 by pulling the cable 82 with the typical brake handle and such that the follower 20 may be rotated about the spindle 100 by the follower 20 in order to rotate the arms 30 about the respective pivot pins 31.

In operation, the springs 40 may bias the arms 30 and thus the magnets 33 toward the peripheral fence 37 of the rotating disc 3, and the arms 30 and thus the magnets 33 may be moved away from the peripheral fence 37 of the rotating disc 3 by the follower 20 such that the brake torque applied to the rotating disc 3 by the magnets 33 may be adjusted by rotating the arms 30 about the pivot pins 31 respectively. the recesses 14 of the base 13 of the plate 10 are provided for receiving the ends 32 of the arms 30 and for limiting the rotational movement of the arms 30 about the respective pivot pins 31.

Figure 6:
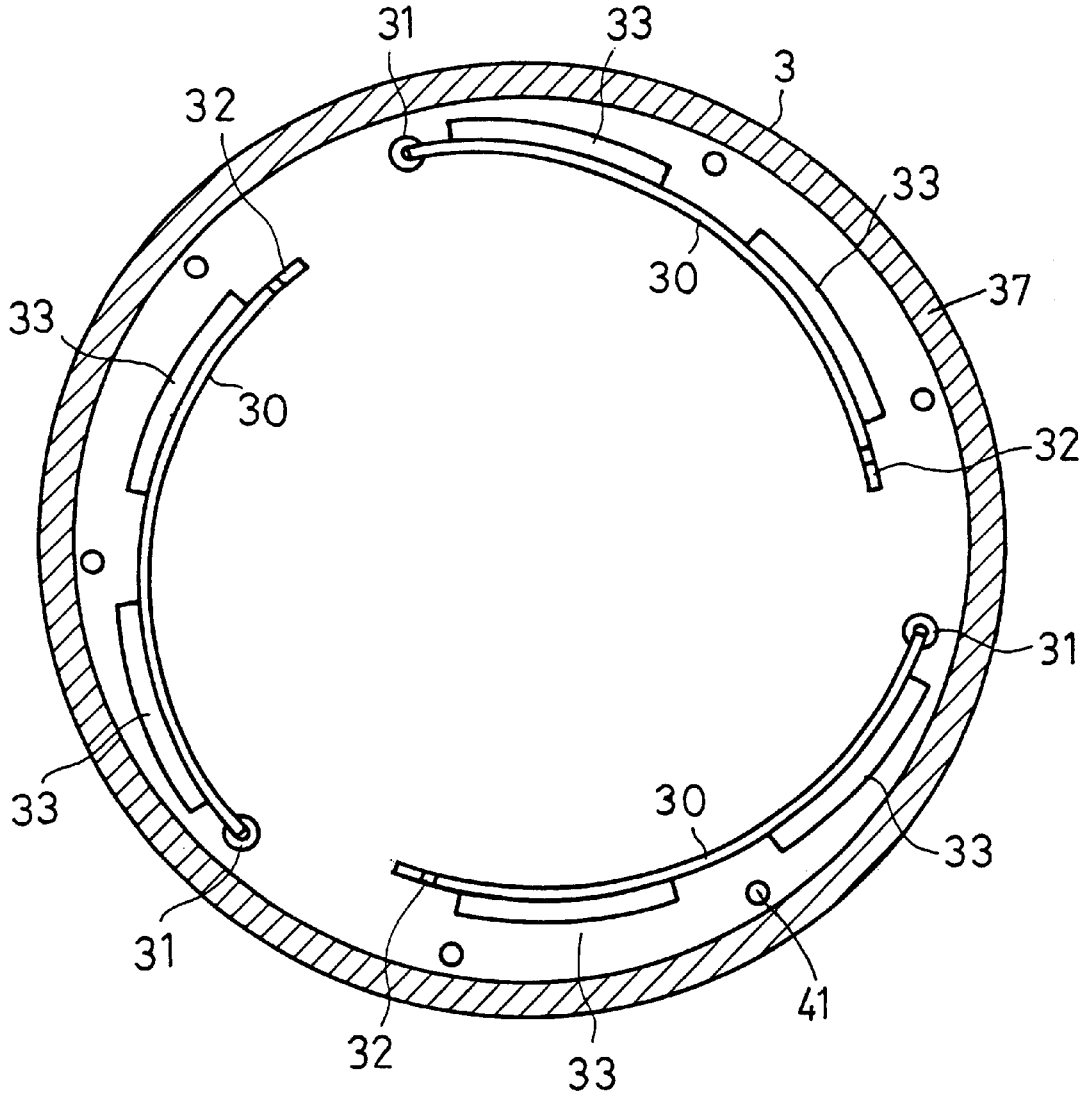
FIG. 6 is a schematic view illustrating the application of the magnetic load applying device as shown in FIGS. 2–4.

Referring next to FIG. 6, illustrated are the arms 30 and the magnets 33 attached onto the arms 30 and the peripheral fence 37. The other members, including the follower 20 and the springs 40 etc., are removed for clearly illustrating the relative position between the arms 30 and the magnets 33 and the peripheral fence 37 of the rotating disc 3. The magnets 33 of the magnetic load applying device may be adjustably moved toward and away from the peripheral fence 37 of the rotating disc 3 in order to adjust the brake torque applied to the rotating disc 3.

Figure 7:
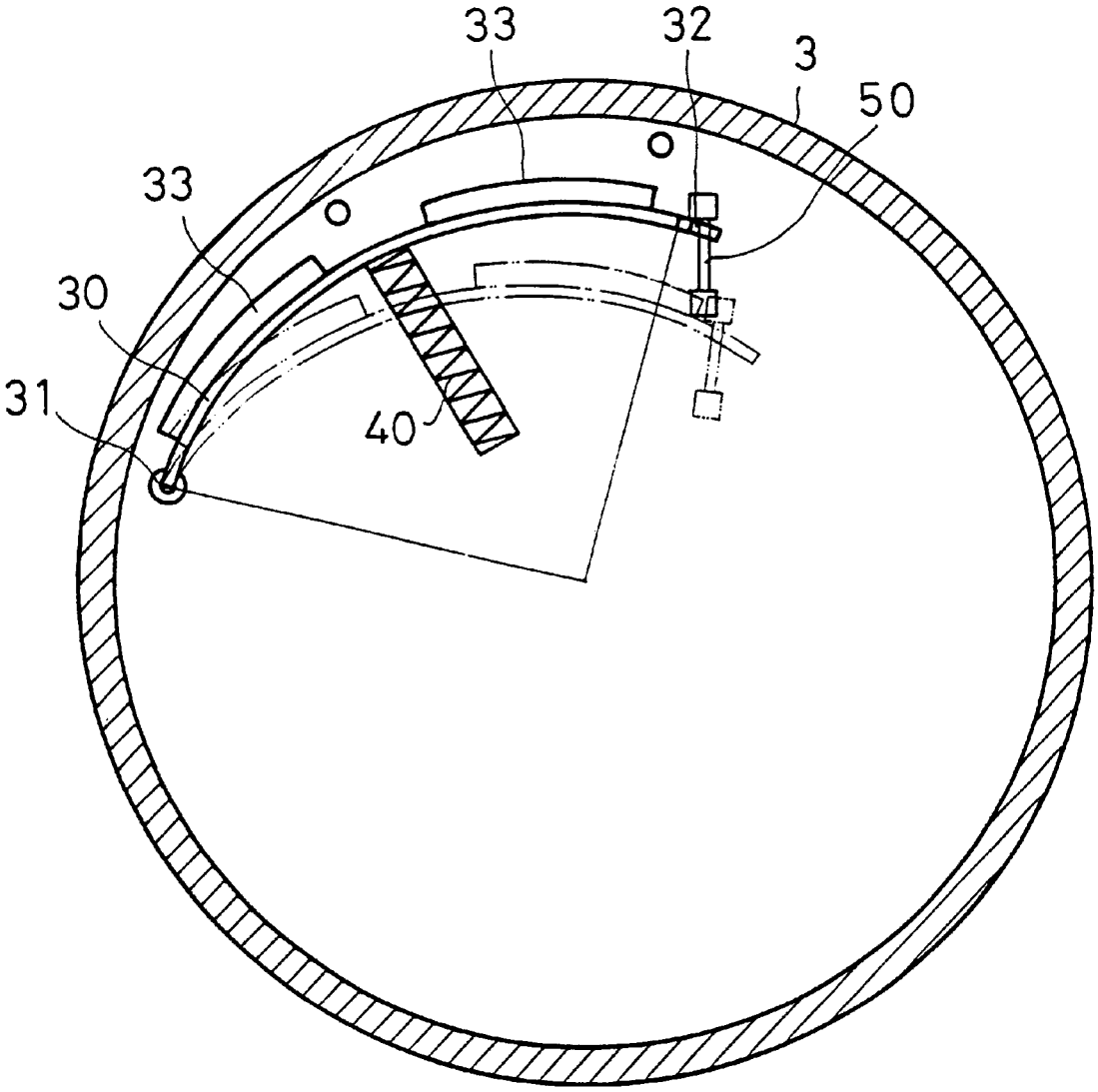
FIG. 7 is a schematic view similar to FIG. 6, illustrating the other application of the magnetic load applying device.

Referring next to FIG. 7, the magnetic load applying device may include four arms 30 each occupies about one quarter of the space defined between the plate 10 and the cover 70. Similarly, the magnetic load applying device may include one or more arms 30 pivotally or rotatably secured to the plate 10 for supporting the magnets 33 and for adjusting the relative position between the magnets 33 and the peripheral fence 37 of the rotating disc 3.

Accordingly, the magnetic load applying device in accordance with the present invention may be used for adjusting the brake torque of the magnets applied to the rotating disc of the exercisers.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A magnetic load applying device comprising:

a spindle, a plate secured on said spindle, said plate including at least one stud extended therefrom, a rotating disc rotatably secured on said spindle and including a peripheral portion, at least one arm including a first end rotatably secured to said plate at a pivot pin, and including a second end, at least one magnet secured on said at least one arm, and means for rotating said at least one arm about said pivot pin to move and to adjust said at least one magnet relative to said peripheral portion of said rotating disc and to adjust a brake torque applied onto said rotating disc, said rotating means including a follower rotatable secured onto said spindle and coupled to said second end of said at least one arm for rotating said at least one arm about said pivot pin when said follower is rotated about said spindle, said follower including at least one extension extended radially outward therefrom and coupled to said second end of said at least one arm for rotating said at least one arm about said pivot pin, said at least one extension including a groove formed therein for receiving said at least one stud and for limiting a relative rotational movement between said follower and said plate.

2. The magnetic load applying device according to claim 1, wherein said rotating means includes means for biasing said at least one arm and said at least one magnet toward said peripheral portion of said rotating disc.

3. The magnetic load applying device according to claim 1, wherein said rotating means includes at least one cable coupled between said follower and said second end of said at least one arm for rotating said at least one arm about said pivot pin.

4. The magnetic load applying device according to claim 1, wherein said rotating means includes a block slidably received in said plate, a first cable coupled between said block and said follower, and a second cable coupled to said block for moving said block relative to said plate to rotate said follower about said spindle.

5. The magnetic load applying device according to claim 1 further comprising a cover secured to said plate for retaining said at least one arm between said plate and said cover.

* * * * *